US006717525B1

(12) United States Patent
Evanoff et al.

(10) Patent No.: US 6,717,525 B1
(45) Date of Patent: Apr. 6, 2004

(54) TACTICAL VECTORING EQUIPMENT

(75) Inventors: Thomas V. Evanoff, Chula Vista, CA (US); William K. Krebs, Burk, VA (US); Thomas H. McCord, Salinas, CA (US); Albert J. Ahumada, Jr., Mountain View, CA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 5 days.

(21) Appl. No.: 10/206,740

(22) Filed: Jul. 26, 2002

Related U.S. Application Data

(60) Provisional application No. 60/310,110, filed on Aug. 2, 2001.

(51) Int. Cl.[7] ..... G08B 5/00

(52) U.S. Cl. ..... 340/815.43; 340/815.65; 340/982; 340/985

(58) Field of Search ..... 340/815.4, 815.43, 340/815.45, 815.54, 815.65, 815.66, 815.67, 815.76, 984, 982, 950, 955, 985; 362/249, 293, 477; 356/416, 326

(56) References Cited

U.S. PATENT DOCUMENTS

| | | | | | |
|---|---|---|---|---|---|
| 3,609,677 | A | * | 9/1971 | Norberg | 340/982 |
| 3,706,968 | A | * | 12/1972 | Turner, Jr. | 340/982 |
| 3,929,398 | A | * | 12/1975 | Bates | 356/416 |
| 4,299,442 | A | * | 11/1981 | Buckelew | 359/548 |
| 4,630,208 | A | * | 12/1986 | Le Pechon | 701/200 |
| 5,426,294 | A | * | 6/1995 | Kobayashi et al. | 250/226 |
| 6,244,728 | B1 | * | 6/2001 | Cote et al. | 362/249 |
| 6,637,915 | B2 | * | 10/2003 | von Wolske | 340/984 |

* cited by examiner

*Primary Examiner*—Van Trieu
(74) *Attorney, Agent, or Firm*—Donald E. Lincoln

(57) ABSTRACT a plurality of bi-color lights is mounted to the stern of a ship such as an aircraft carrier. The lights are arranged so that they are visible from an escort ship that is following the aircraft carrier while attempting to maintain a selected range and angular position relative to the aircraft carrier. The lights are arranged such that the number of lights of each color that are visible from the escort ship depends upon the angular position of the escort ship relative to the aircraft carrier.

3 Claims, 5 Drawing Sheets

TACTICAL VECTORING EQUIPMENT

CROSS REFERENCE TO RELATED APPLICATION

Applicant claims the benefit of U.S. Provisional Application Ser. No. 60/310,110 filed Aug. 2, 2001 for Tactical Vectoring Equipment.

BACKGROUND OF THE INVENTION

This invention relates generally to navigation equipment and particularly to equipment for conning a ship at night, especially during plane-guard operations in which a ship follows an aircraft carrier at a selected distance. In addition, this invention can be used for any land, sea, or air navigation where a person or vehicle moves to a specific location.

Operating a surface combatant at night in close proximity to an aircraft carrier can be one of the most challenging and dangerous tasks at sea. During a plane guard task for example, an aircraft carrier is launching and recovering aircraft while the surface combatant is positioned a few thousand yards astern of the aircraft carrier. The surface combatant's conning officer's attention is divided between gauging the location of the aircraft carrier, monitoring aircraft traffic, searching the water for other vessels, and avoiding foreign obstacles. To accomplish these tasks, the combatant's conning officer must estimate the aircraft carrier's distance and bearing by visual and auditory information; however, in certain situations these cues may be ambiguous which may lead to a loss of situational awareness by the conning officer.

For centuries, sailors used navigation aids, such as flags, smoke and lights, to signal and maneuver around ships and other obstacles. Early navigation aids date back to the Roman era, around 300 B.C., when lighthouses built near the mouth of the Nile were used to guide ships and assist with coastal navigation. During the U-boat battles of World War I, convoys of 20 or more supply ships would transit the Atlantic Ocean in tight-knit packs at ranges as close as 750 yards. Radar had not yet been developed, so the conning officer viewed red and white lights mounted on the vessel to maintain a safe distance between ships. When engaging the enemy, British destroyers illuminated two red lamps spaced two meters apart horizontally on the port yardarm, and two green lamps on the starboard yardarm. Ocean vessels of today are equipped with advanced navigation systems such as radar, global positioning system, and automatic pilot systems to enhance conning officers' situational awareness. Despite these advanced navigation systems collisions between surface vessels still occur. Typically a collision occurs after a ship's crew loses situational awareness of the surrounding area.

SUMMARY OF THE INVENTION

The present invention comprises a Tactical Vectoring Equipment (TVE) that includes a plurality of lights mounted on the stem of the aircraft carrier for assisting shipboard conning officers when maneuvering in a battle group formation.

The tactical vectoring Equipment preferably comprises six red and green lights mounted on the stem of an aircraft carrier. The lights are preferably arranged in a linear array with the lights being spaced approximately six to nine feet apart. The lights are clearly visible to a conning officer on an escort ship while being invisible to the carrier pilots during flight operations such as landing or approaching the flight deck. The lights are arranged such that the number of red and green lights seen from an escort ship that is astern the aircraft carrier depends on the angular orientation of the vector between the escort ship and the aircraft carrier. The red and green light configuration of the tactical vectoring Equipment enables the conning officer to easily discriminate range and bearing of the stern of the aircraft carrier in relation to the escort ship, thereby providing increased situational awareness for conning officers during battle group formations.

Accordingly, it is an object of this invention to provide an improved navigation device for maritime operations.

It is another object of this invention to improve training of maritime conning officers. Most conning officers spend many hours on watch in order to develop an accurate understanding of how a ship turns and maneuvers. This is because, for the most part, they are guessing how a carrier will turn and react at different speeds. Through trial and error, and under the careful guidance of their commanding officers, conning officers will eventually develop a sense of the relative motion between ships. The present invention provides an immediate indication of how the ship is turning and the characteristics of the turn. For example, the faster the TVE lights change colors, the faster the carrier is turning. This gives the conning officer an immediate visual indication of the carrier's advance/transfer rates and its effect on relative position. Thus, the TVE is a useful training aid that can develop and improve a junior naval officer's ship-handling skills more quickly.

It is another object of this invention to provide feedback to the conning officer of the escort ship when the lead ship reverses course. When a backing engine is ordered (throttles in the backing position on the ship's control console), a relay circuit temporally modulates the TVE lights in unison. This provides an immediate warning signal to the escort ship's conning officer that the carrier is backing, decreasing speed more rapidly, and may actually transit backwards.

It is another object of this invention to aid restricted emission control (EMCON) operations. During battle conditions and mission requirements that restrict the use of ship's radar and line-of-sight communications systems, the TVE could still operate. The lights have a specified vertical arc of visibility to prevent interference with pilots. The TVE can be seen for only a few miles at sea level and preferably is restricted vertically to less than one degree above the horizon in order to support operation with the carrier's aircraft.

It is another object of this invention to provide visual guidance for maritime column formation, underway replenishment, and any other application where two or more surface vessels need to rendezvous, follow each other, change course, or depart formation.

It is another object of this invention to estimate range to another vessel without the use of radar. A common technique used by mariners involves using a set of binoculars and a ship's dimensions to determine range. At a given range, binoculars have a set field of view (FOV) across the lens. For example, a standard set of binoculars (7×50) at a range of 1,000 yards has an FOV of 360 feet. This means that an object having a length of 45 feet would fill one-eighth of the binocular lens. At 500 yards the FOV is 180 feet. The same object having a length of 45 feet now fills one-quarter of the binocular lens. Using this example, if the lights are positioned nine feet apart, then total length of the TVE array is 45 feet. An approximate distance to the vessel can now be determined by applying this principal. This provides immediate bearing and range information to the conning officer, improving his ability to accurately form a mental picture of the carrier's heading and target angle.

It is another object of this invention to provide visual land guidance to traverse from one location to the next. The TVE could direct a vehicle to a desired location, e.g., an aircraft could follow the TVE lights to a designated point on the airport surface.

It is another object of this invention to provide precise navigation guidance by changing the spacing between the lights and the distribution of red and green lights within a light unit. Furthermore, the two colors selected for the TVE do not have to be red or green.

DETAILED DESCRIPTION OF THE INVENTION

Figure 1:
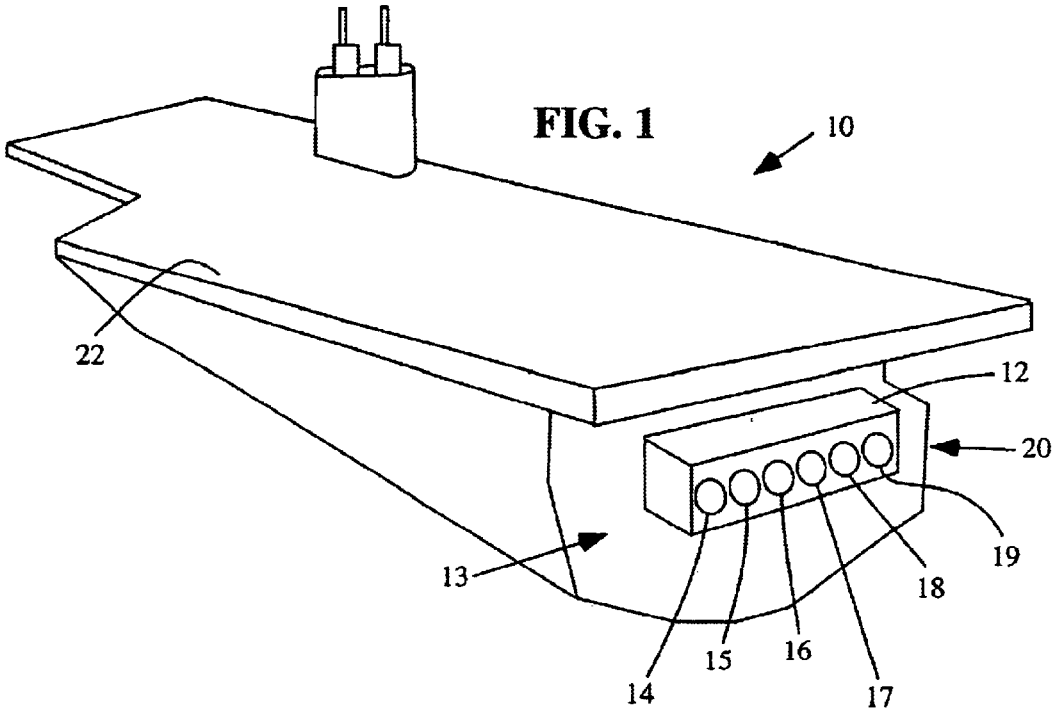
FIG. 1 illustrates an array of lights on the stem of a ship such as an aircraft carrier.

FIG. 1 illustrates an aircraft carrier 10 with a tactical vectoring Equipment (TVE) 12 according to the invention mounted thereto. In a preferred embodiment the TVE 12 comprises a plurality of lights 14–19 arranged in a horizontal linear array 20. The array preferably includes the six bi-color (e.g. red and green; however this Invention Is not limited to these two colors) lights 14–19 spaced approximately six feet apart on a stem portion 13 of the aircraft carrier 10. The TVE 12 may be mounted just below the aircraft carrier's flight deck 22 approximately 60 feet above the waterline. Each of the lights 14–19 has a diameter of 18 inches and a luminous intensity of approximately 12 candelas.

Figure 2:
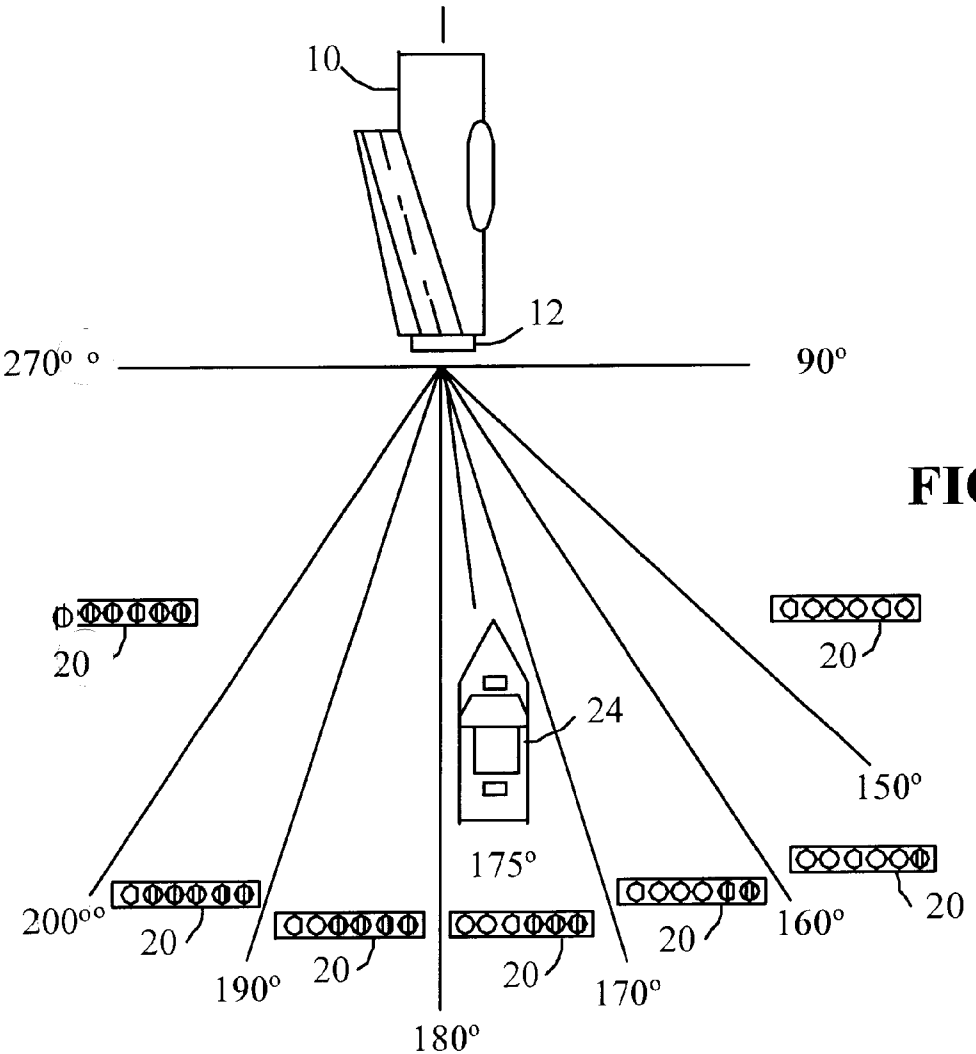
FIG. 2 illustrates the visual appearance of the array of lights as seen by an observer in an escort ship at various angular positions astern the aircraft carrier; Note: Although each unit has a different distribution of red and green filter the observer only perceives one color depending upon his or her location relative to the lights.

FIG. 2 illustrates the visual appearance of the array 20 of lights 14–19 as seen by an observer in an escort ship 24 at various angular positions astern the aircraft carrier 10. In FIG. 2, the lights are indicated as small circles. Shading is included in some of the circles to indicate color. The vertical shading lines in the circles should be understood to indicate the color green. An unshaded circle should be understood to represent a red light. The observer will not perceive the red and green light simultaneously when viewing a single light; instead the observer will only perceive one light (red or green) depending upon the observer's location relative to the light. The TVE 12 preferably includes a red filtered Fresnel lens, a green filtered Fresnel lens and a light source. As shown in FIG. 2, the fresnel lenses and filters are preferably arranged so that 6 red and 0 green lights are only visible when the escort ship 24 is in an angular region greater than 200° relative to the stem 13 of the aircraft carrier 10. When the escort ship 24 is between 190° relative of the stem 13 of the aircraft carrier 10, 5 red lights and 1 green light are only visible. When the angle is between 180° and 190°, 4 red lights and 2 green lights are only visible. When the escort ship is at the preferred 175° position, 3 red lights and 3 green lights are only visible. For angles between 160°, 2 red lights and 4 green lights may be seen. If the angle is between 150° and 160°, then 1 red light and 5 green lights are only visible. When the escort ship 24 is at an angle less than 150° relative to the stem 13 of the aircraft carrier 10, 6 red lights and 0 green light are only visible. Thus, even though each light unit has a single light source with different distributions of red and green filters, the observer will only perceive one color (red or green) depending upon the relative location to the array of lights.

Figure 3:
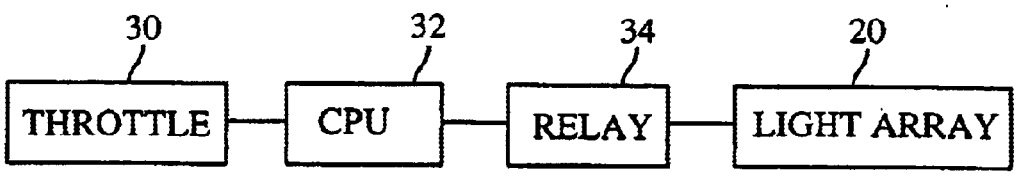
FIG. 3 is a block diagram of electrical circuitry that may be connected between the throttle of the aircraft carrier and the array of lights.

FIG. 3 is a block diagram of a warning system that may be included in the aircraft carrier 10. The aircraft carrier 10 has a throttle 30 that is used to control its speed and forward/aft motion. A central processing unit (CPU) 32 receives signals from the throttle to indicate whether the aircraft carrier is moving forward or backward. A relay 34 is connected between the CPU 32 and the light array 20. The CPU 30 is arranged to actuate the relay 34 when the aircraft carrier 10 reverses course. When the throttle 30 is in the backing position, the relay 34 modulates the array 20 so that all the lights blink in unison to provide feedback to the conning officer of the escort ship 24 when the lead ship reverses course.

Figure 4:
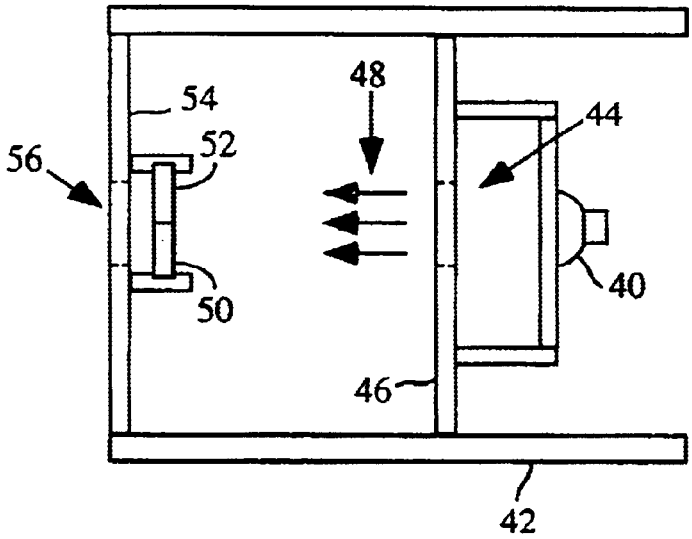
FIG. 4 is top plan view of the interior of a housing having a lamp structure that may be included in the present invention mounted therein.
Figure 5:
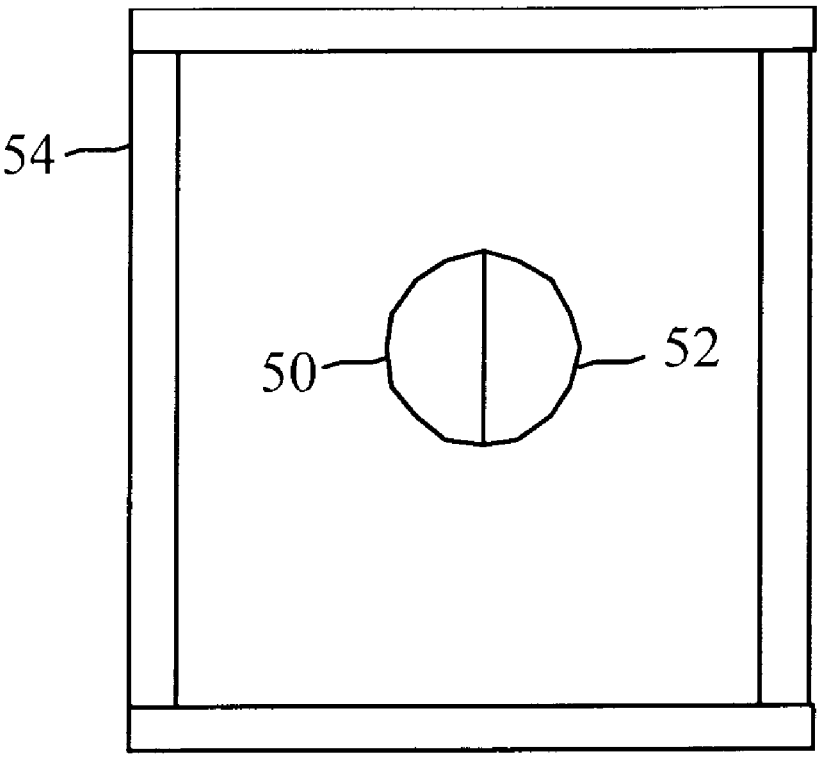
FIG. 5 is a front elevation view of a lens and lens mount bulkhead that may be included in the apparatus of FIG. 3.
Figure 6:
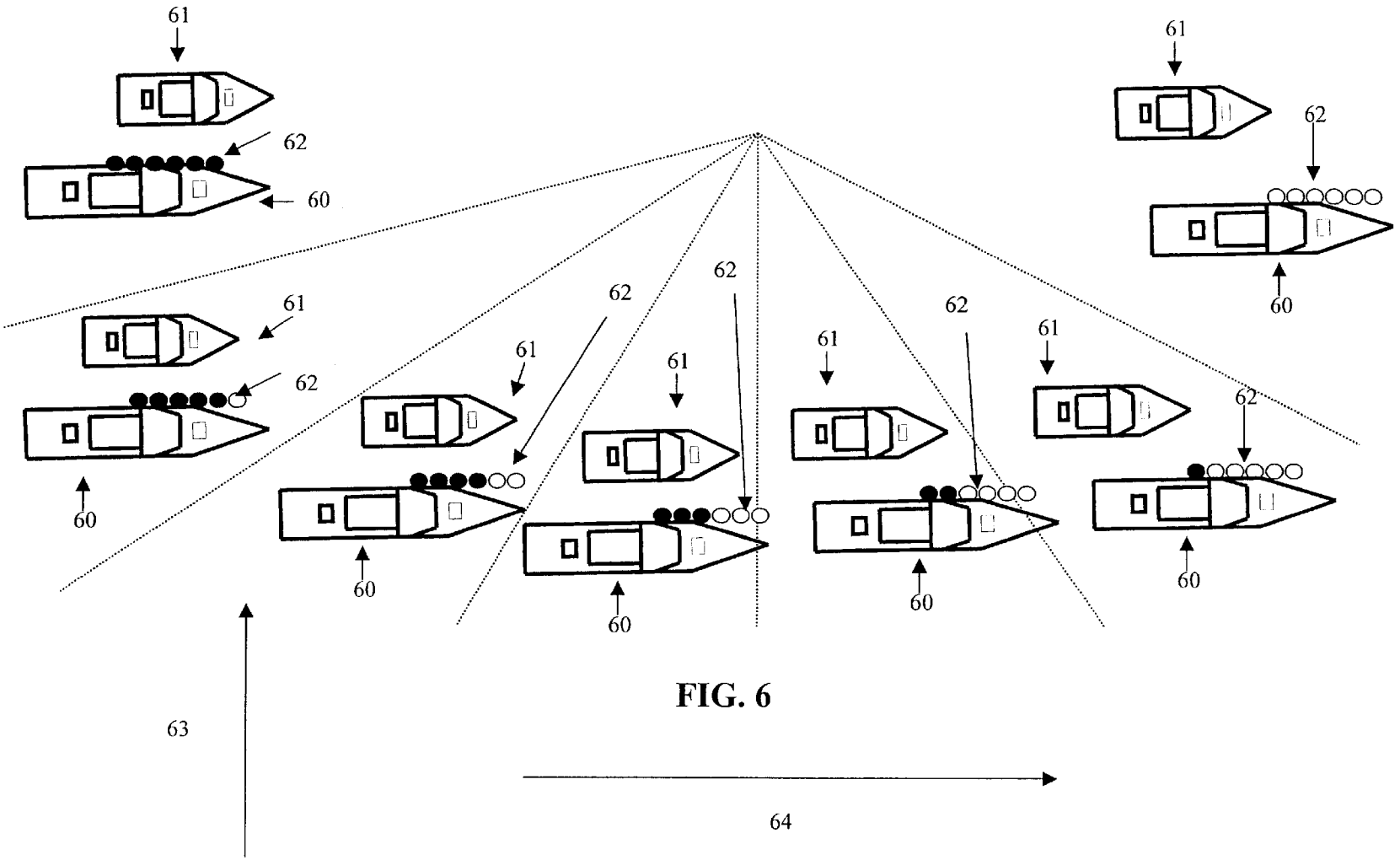
FIG. 6 is a top plan view of the TVE mounted on the port side of the supply ship with the replenishment ship maintaining safe distance

FIGS. 4 and 5 show a structure that may be used for each of the lights 14–19 in the light array 20. A lamp 40 is mounted in a housing 42. Light emitted from the lamp 40 passes through a hole 44 that is formed in an interior bulkhead 46 in the housing 42. The light passes through the hole 44 and emerges as a beam 48 that is incident upon a red filtered fresnel lens 50 and a green filtered fresnel lens 52 arranged in side-by-side relationship. The Fresnel lenses 50 and 52 are mounted to a bulkhead 54 that has a hole 56 arranged to allow light that has passed through the Fresnel lenses 50 and 52 to be emitted from the housing. The Fresnel lenses 50 and 52 in the separate lights 14–19 are arranged so that the patterns of lights described above with respect to FIG. 2 are visible from the escort ship 24 when it is in the angular zones described above.

FIG. 5 is a top view of the TVE 62 mounted on the port side of a supply ship 60 while the replenishment ship 61 is located at a safe distance from the supply ship. The observer located on the replenishment ship observes the TVE 62 lights change from red to green to indicate whether the two ships are aligned in the vertical 63 or horizontal 64 plane. The TVE 62 lights similar to FIG. 2, except an open circle should be understood to indicate the color green. A black circle should be understood to indicate a red light.

The present invention provides an immediate indication of angular rate at which the aircraft carrier 10 turns relative to the escort ship 24. For the example described above, the display changes the number of red and green lights that are visible from the escort ship for every ten degrees of angular change. Dividing the ten degree angular increment by the time interval required for the display pattern to change provides an estimate of the rate at which the aircraft carrier 10 is turning relative to the escort ship 24. For example, the faster the TVE 12 lights change colors, the faster the carrier is turning. This gives the conning officer an immediate visual indication of the carrier's advance/transfer rates and its effect on relative position. Thus, the TVE 12 is a useful training aid that can develop and improve a junior naval officer's ship-handling skills more quickly.

The offset can be adjusted to any specification depending upon the desired angle. Currently, the angle is set for 10 degree increments. This angle can increase or decrease depending upon the ratio of the red and green filters specified by the offset.

During routine underway operations and in between flight cycles, the aircraft carrier 10 displays standard or "normal" navigation/running lights for a ship of that size. Such lights include a starboard green running light, port red running light, white stern running light, and two white range lights fore and aft. These are referred to as the "normal lighting configuration."

Sea trial tests (Apr. 20$^{th}$, 2001 the TVE 12 was mounted on the stem of the USS John F. Kennedy (CV-67) while conning officers on the USS The Sullivans (DDG-68) maintained plane guard position astern of the CV-67 by viewing the TVE 12) have shown that the TVE 12 provides an improved capability of estimating range and angular position of the escort ship 24 relative to the aircraft carrier significantly better than the normal lighting display.

The invention can be used to aid restricted emission control (EMCON) operations. During battle conditions and mission requirements that restrict the use of ship's radar and line-of-sight communications systems, the TVE 12 could still operate. The TVE 12 can be seen for only a few miles at sea level and preferably is restricted vertically to less than one degree above the horizon in order to support operation with the carrier's aircraft.

The TVE 12 may be used to provide visual guidance for maritime column formation, underway replenishment, and any other application where two or more surface vessels need to rendezvous, follow each other, change course, or depart formation. During underway replenishment the TVE 12 system would be mounted on the bow of the supply ship 60. The replenishment ship 61 would maintain safe distance from the supply ship 60 by viewing the TVE 12 lights.

The TVE 12 allows estimation of the range to another vessel without the use of radar. A common technique used by mariners involves using a set of binoculars and a ship's dimensions to determine range. At a given range, binoculars have a set field of view (FOV) across the lens. For example, a standard set of binoculars (7×50) at a range of 1,000 yards has an FOV of 360 feet. This means an object that is 45-feet-long would fill one-eighth of the binocular lens. At 500 yards the FOV is 180 feet. An array 20 that is 45 feet long fills one-quarter of the binocular lens at a range of 500 yards. An approximate distance to the vessel can now be determined by applying this principal. This would provide immediate bearing and range information to the conning officer, improving his ability to accurately form a mental picture of the carrier's heading and target angle.

What is claimed is:

1. A vectoring system for indicating relative angular position of a first object at a first location relative to a second object at a second location, comprising:

a plurality of bi-color lights mounted on the first object such that each of the lights is visible from the second location, each light including a lamp arranged to produce a light beam, a first filtered lens arranged to receive the light beam from the lamp and produce a plurality of light beams of a first color along selected angles and a second filtered lens arranged to receive the light beam from the lamp and produce a plurality of light beams of a second color along selected angles, the light beams of the first and second colors being arranged such that the number of lights of each color that are visible at selected angles indicate the relative angular orientation of the first and second objects.

2. The vectoring system of claim 1 wherein the bi-color lights are arranged in a linear array.

3. The vectoring system of claim 1 wherein the first and second filtered lenses comprise Fresnel lenses.

* * * * *